US008490962B2

(12) United States Patent
Ishikawa et al.

(10) Patent No.: US 8,490,962 B2
(45) Date of Patent: Jul. 23, 2013

(54) RECORDING APPARATUS

(75) Inventors: So Ishikawa, Shiojiri (JP); Toshimitsu Ohara, Matsumoto (JP)

(73) Assignee: Seiko Epson Corporation, Tokyo (JP)

( * ) Notice: Subject to any disclaimer, the term of this patent is extended or adjusted under 35 U.S.C. 154(b) by 67 days.

(21) Appl. No.: 12/875,361

(22) Filed: Sep. 3, 2010

(65) Prior Publication Data

US 2011/0057379 A1 Mar. 10, 2011

(30) Foreign Application Priority Data

Sep. 4, 2009 (JP) ..... 2009-204594

(51) Int. Cl.
*B65H 3/44* (2006.01)

(52) U.S. Cl.
USPC ..... 271/9.01; 271/9.13; 271/9.11; 271/117; 271/118; 271/164

(58) Field of Classification Search
USPC ..... 271/117, 118, 162, 164, 9.01, 9.08, 271/9.11, 9.13, 111
See application file for complete search history.

(56) References Cited

U.S. PATENT DOCUMENTS

| | | | | |
|---|---|---|---|---|
| 7,500,666 | B2 | 3/2009 | Yanagishita | |
| 2004/0012139 | A1 * | 1/2004 | Asada et al. | 271/113 |
| 2006/0163796 | A1 * | 7/2006 | Shiohara et al. | 271/9.01 |
| 2008/0088079 | A1 * | 4/2008 | Yanagishita | 271/121 |
| 2008/0150221 | A1 * | 6/2008 | Sugiyama et al. | 271/202 |

FOREIGN PATENT DOCUMENTS

| | | |
|---|---|---|
| JP | 2003-171027 | 6/2003 |
| JP | 2008-030927 | 2/2008 |
| JP | 2008-074581 | 4/2008 |
| JP | 2008-213977 | 9/2008 |
| JP | 2009-007175 | 1/2009 |

* cited by examiner

*Primary Examiner* — Michael McCullough
*Assistant Examiner* — Howard Sanders
(74) *Attorney, Agent, or Firm* — Workman Nydegger

(57) ABSTRACT

A recording apparatus according to an aspect of the invention includes a sheet feeding cassette that can accommodate a stack of recording materials; a pick-up roller that comes into contact with the top recording material of the recording materials accommodated in the sheet feeding cassette to feed the recording material; a roller holder that is supported at a base end so as to be rotatable and has the pick-up roller at a tip, the pick-up roller being pressed against the recording material; and a lever that is supported at a base end so as to be rotatable and has a pressing portion at a tip, the pressing portion being pressed against the recording material. The lever is disposed on the roller holder and is supported coaxially with the roller holder.

7 Claims, 7 Drawing Sheets

RECORDING APPARATUS

BACKGROUND

1. Technical Field

The present invention relates to recording apparatuses that can hold a stack of recording materials and feed the recording materials sequentially from the top, such as printers and facsimiles.

2. Related Art

Cassette-type ink jet printers having a cassette fitted to a printer body and accommodating a stack of sheets serving as recording materials, the sheets being fed from the cassette are known. Some cassettes have edge guides that can be moved according to the size of the sheets, so that different types and sizes of sheets can be accommodated.

In general, a pick-up roller that feeds sheets is disposed at a position shifted to the reference position side (one-digit side) in the sheet-width direction so that small sheets can be fed. Therefore, when feeding large sheets, the pick-up roller is located at a position shifted to the one-digit side with respect to the center position of the sheets in the width direction. However, this causes sheet skew because the sheet transportation orientation at the position of the pick-up roller is different from that at a position distant from the pick-up roller.

To counter this, the recording apparatus disclosed in JP-A-2009-7175 is configured to have a "raised portion" serving as a pressing portion. The raised portion has substantially the same shape as the pick-up roller and is provided coaxially with the pick-up roller to make the sheet transportation orientation uniform in the sheet-width direction.

In a single-tray cassette, because the cassette cannot accommodate different types of sheets at the same time, the sheets have to be replaced each time. To counter this, a multi-tray cassette structure having a plurality of trays stacked vertically has been proposed, so that the cassette can accommodate different types of sheets at the same time.

In the multi-tray cassette structure, small sheets accommodated in the second tray are fed one by one as the pick-up roller disposed thereon rotates. However, sheet skew can be caused by the urging force of the pressing portion that are resting on the second tray together with the pick-up roller, as well as by the strain (the difference in pressing force) between the pick-up roller and pressing portion.

SUMMARY

An advantage of some aspects of the invention is that it provides a recording apparatus that can prevent skew in the multi-tray cassette structure.

A recording apparatus according to an aspect of the invention includes a sheet feeding cassette that can accommodate a stack of recording materials; a pick-up roller that comes into contact with the top recording material of the recording materials accommodated in the sheet feeding cassette to feed the recording material; a roller holder that is supported at a base end so as to be rotatable and has the pick-up roller at a tip, the pick-up roller being pressed against the recording material; and a lever that is supported at a base end so as to be rotatable and has a pressing portion at a tip, the pressing portion being pressed against the recording material. The lever is disposed on the roller holder and is supported coaxially with the roller holder.

According to an aspect of the invention, because the pick-up roller and the pressing portion that adjusts the orientation of the recording material in cooperation with the pick-up roller are provided separately, the load on the pick-up roller and the load on the pressing portion can be independently controlled. Thus, even when different types and sizes of recording materials are used, no load is applied to the pick-up roller. Thus, sheet skew can be prevented.

The sheet feeding cassette accommodating the recording materials may include a first tray that accommodates a first recording material and a second tray that is disposed above the first tray and accommodates a second recording material smaller in width than the first recording material. The lever may include a position-regulating portion such that the lever is located at a distance from the top surface of the roller holder when the second recording material is fed.

In this case, in a multi-tray cassette structure in which different types and sizes of recording materials can be accommodated at the same time, when a second recording material accommodated in the second tray disposed above the first tray is fed by the pick-up roller, the lever is located at a distance from the top surface of the roller holder because of the position-regulating portion. Therefore, the load of the lever is prevented from being transmitted to the roller holder. Thus, when the second tray is used, the load of the lever is prevented from being transmitted to the roller holder (pick-up roller), preventing skew.

Furthermore, the second tray may have, in the top surface, a groove that receives the pressing portion of the lever when the second tray is used, and the position-regulating portion may come into contact with the top surface of the second tray and may have a height such that it projects toward the second tray from the inner surface of the lever facing the top surface of the roller holder.

In this case, because the position-regulating portion, which has a height such that it projects toward the second tray from the inner surface of the lever in contact with the top surface of the roller holder, comes into contact with the top surface of the second tray, a clearance can be formed between the lever and the roller holder. Thus, the load of the lever can be assuredly prevented from being transmitted to the roller holder.

Furthermore, the pressing portion may be a driven roller having the same diameter as and coaxial with the pick-up roller.

In this case, because the pressing portion provided at the tip of the lever is the driven roller having the same diameter as and coaxial with the pick-up roller, and because the pressing portion is rotated by the movement of the recording material fed by the pick-up roller, skew can be more assuredly prevented.

Furthermore, an urging member may be connected to each of the roller holder and the lever.

In this case, because an urging member is connected to each of the roller holder and the lever, a predetermined load can be applied to each of the roller holder and the lever that are provided separately.

BRIEF DESCRIPTION OF THE DRAWINGS

The invention will be described with reference to the accompanying drawings, wherein like numbers reference like elements.

DESCRIPTION OF EXEMPLARY EMBODIMENTS

An embodiment of the invention will be described below with reference to the drawings, in which the components are not to scale for clarity's sake.

Figure 1:
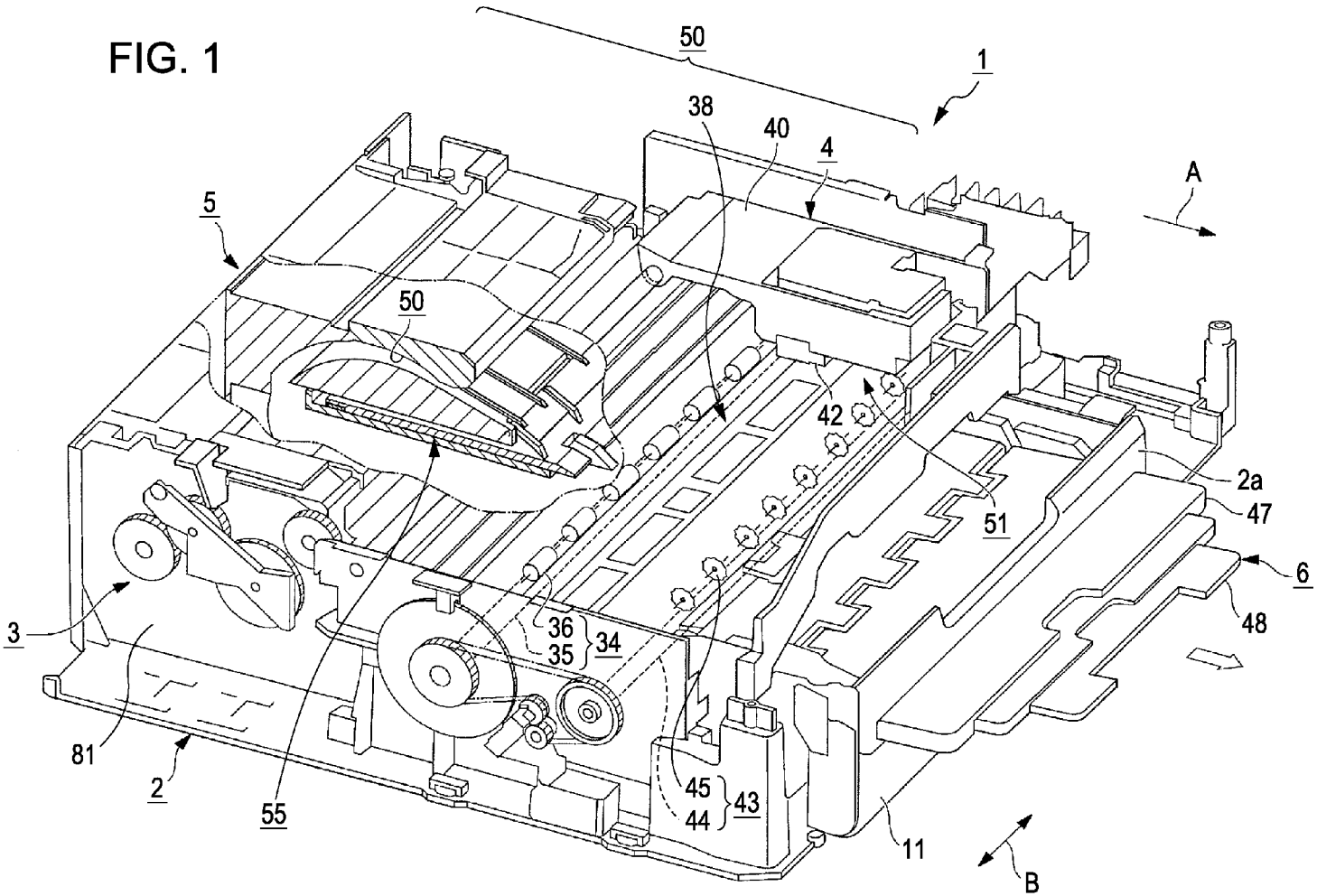
FIG. 1 is a perspective view showing the internal structure of an ink jet printer according to this embodiment.
Figure 2:
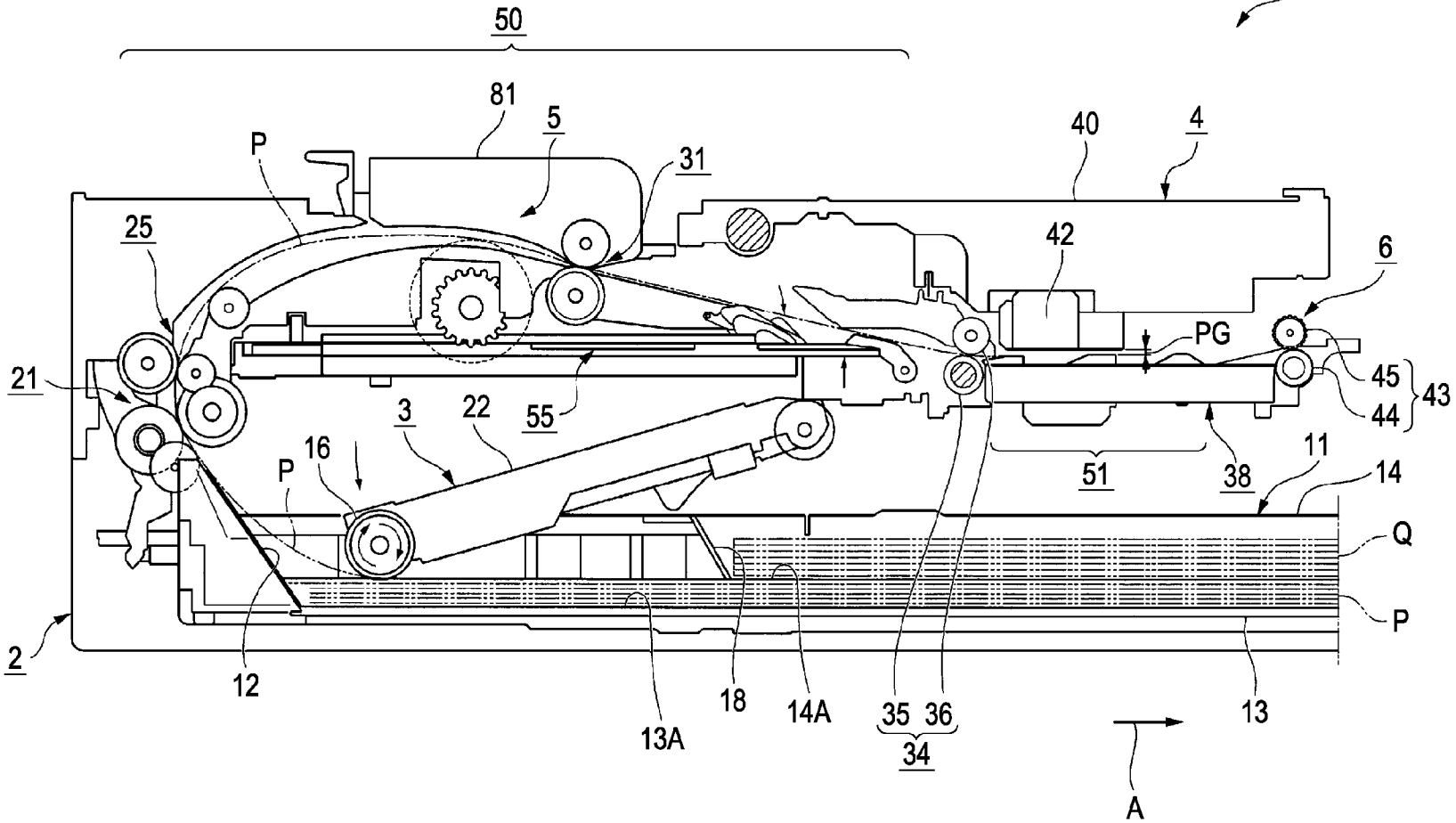
FIG. 2 is a cross-sectional view showing the internal structure of the ink jet printer.
Figure 3A:
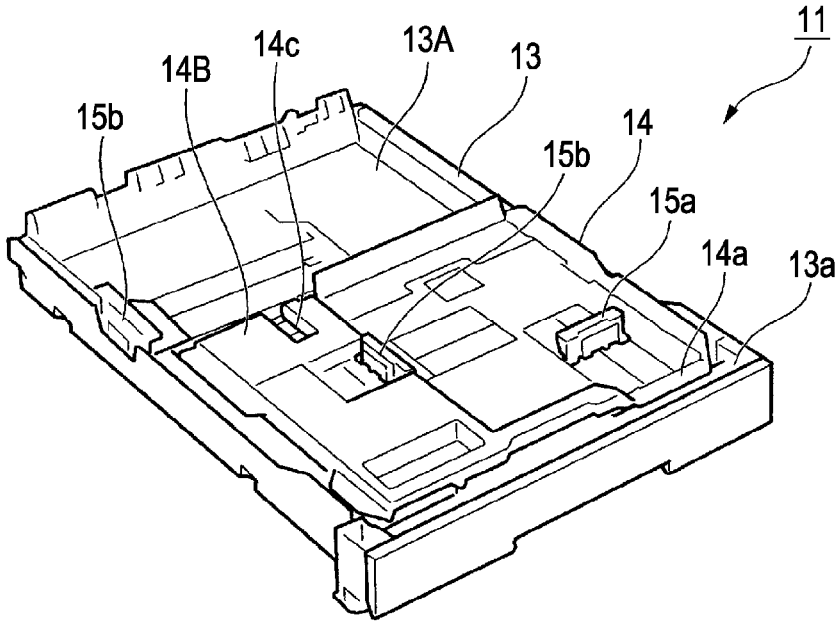
FIGS. 3A and 3B are perspective views showing the structure of a sheet feeding cassette.
Figure 3B:
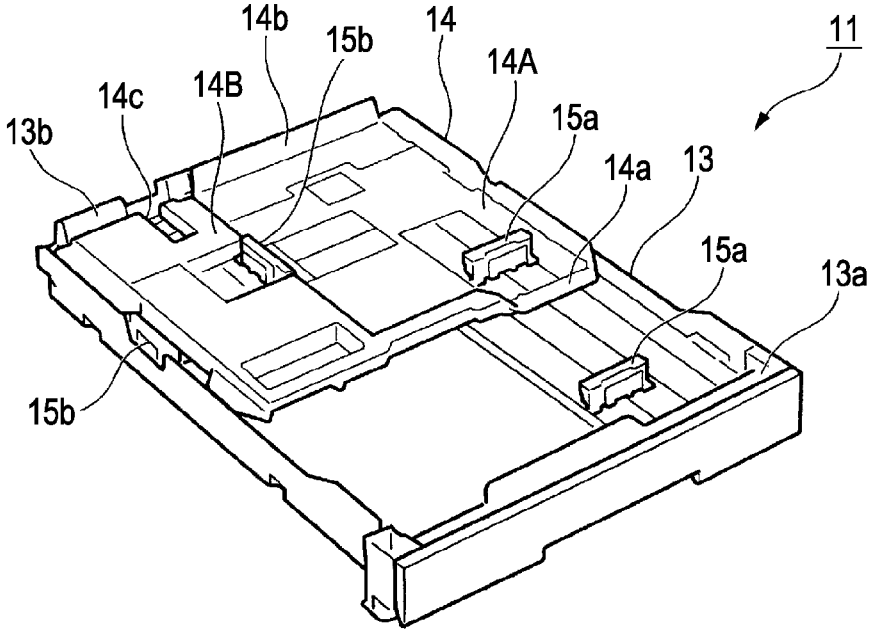
Figure 4:
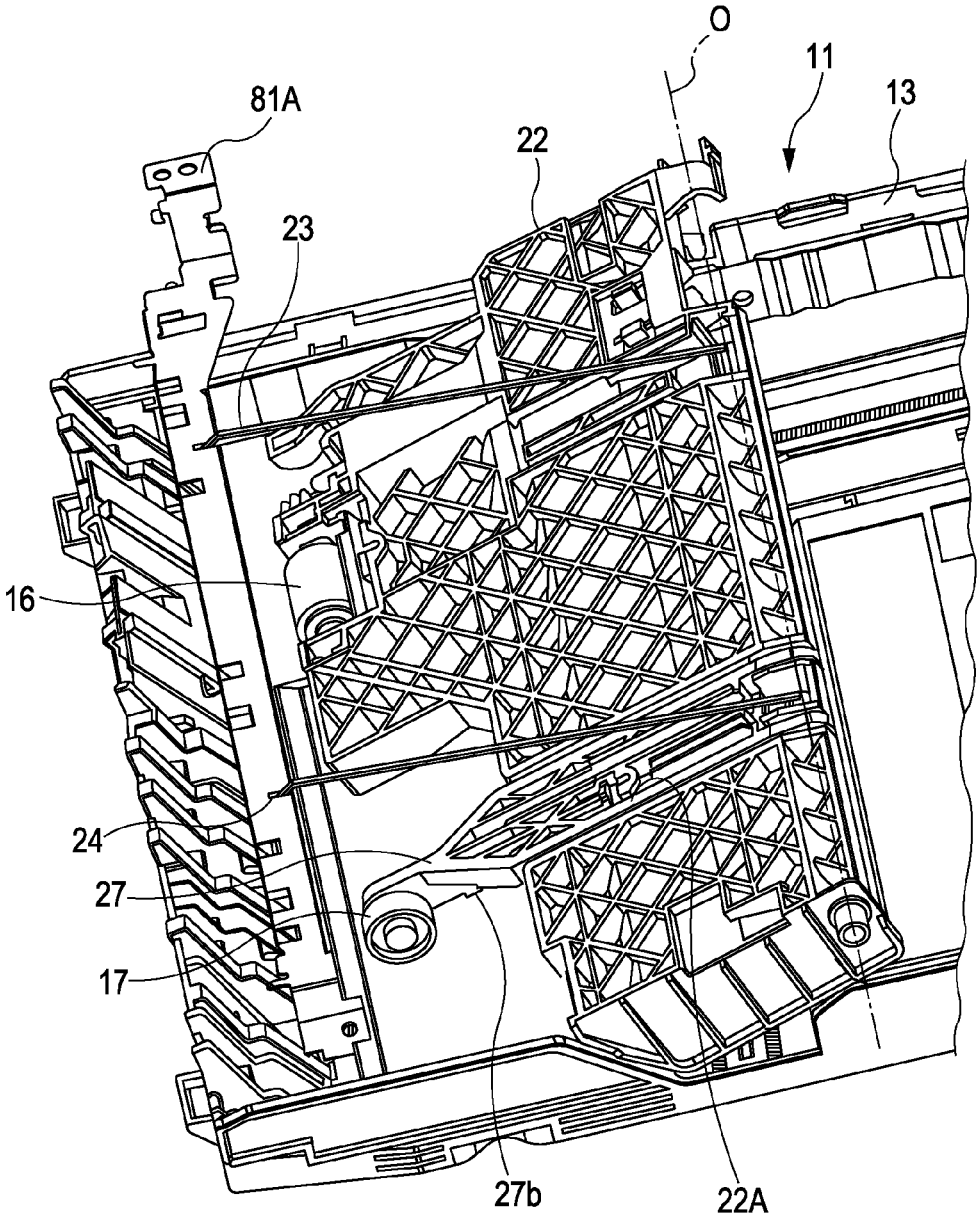
FIG. 4 is a perspective view showing a state in which a second tray is located at a retracted position when the cassette is fitted.
Figure 5:
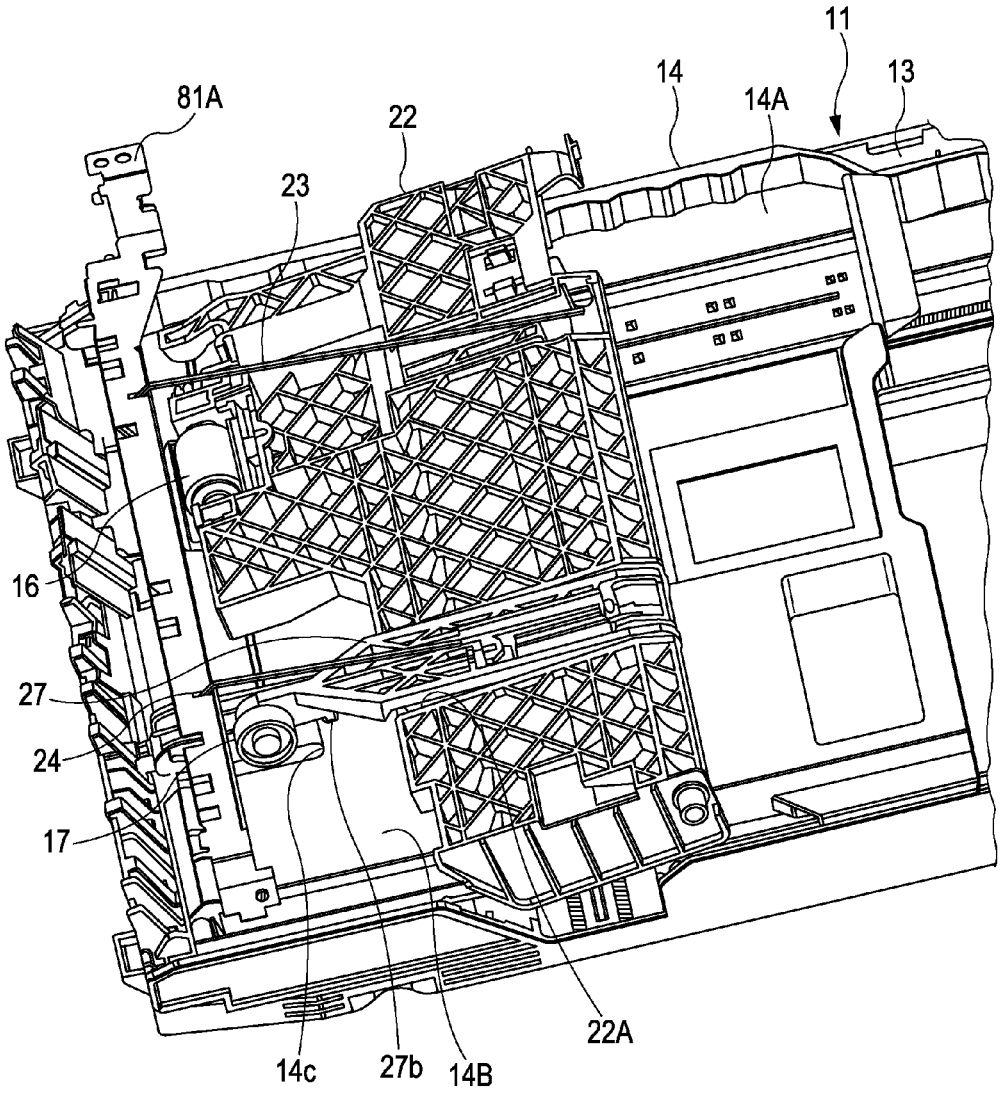
FIG. 5 is a perspective view showing a state in which the second tray is located at a feeding position when the cassette is fitted.
Figure 6:
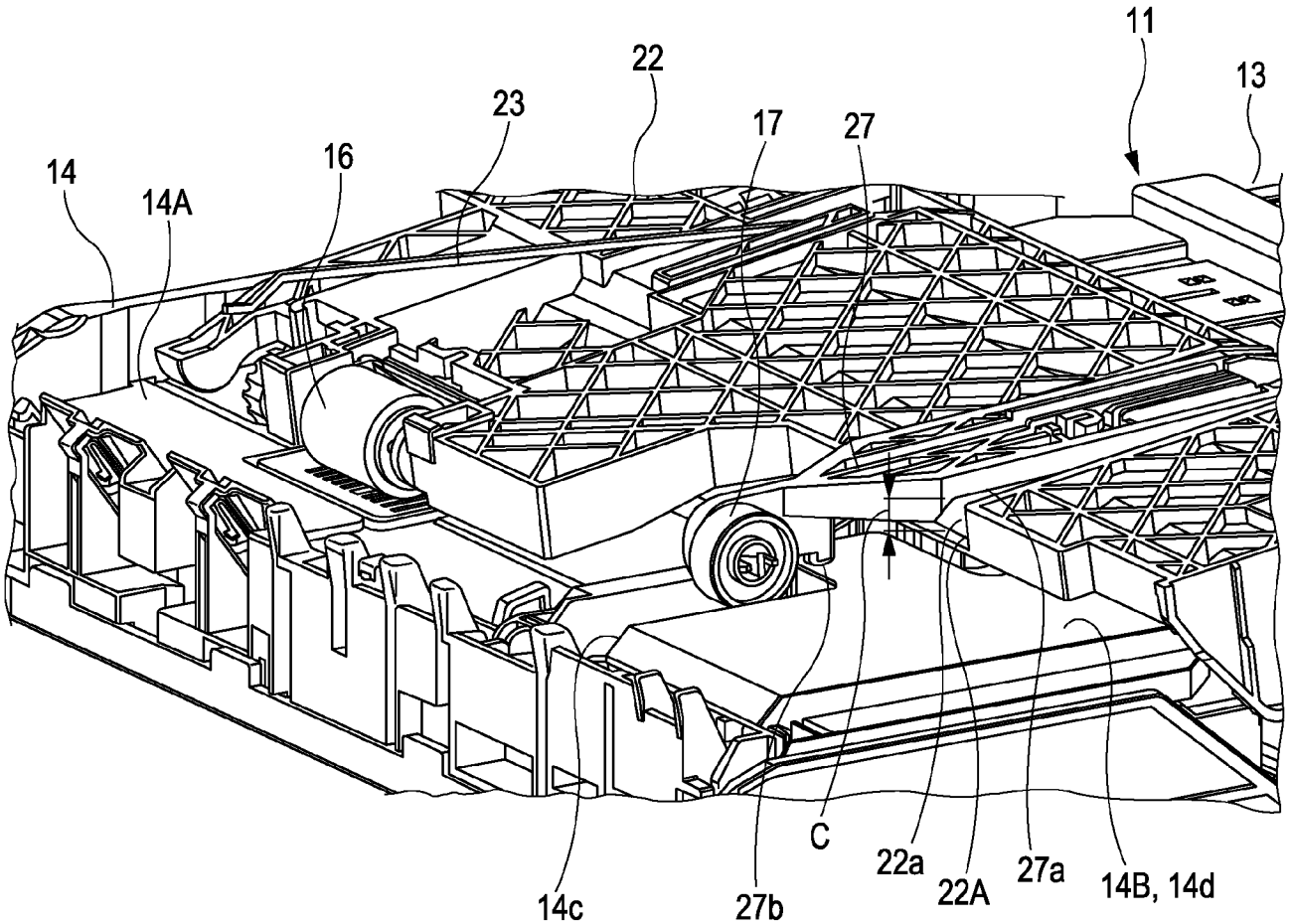
FIG. 6 is a perspective view showing a state in which a lever is retracted.
Figure 7A:
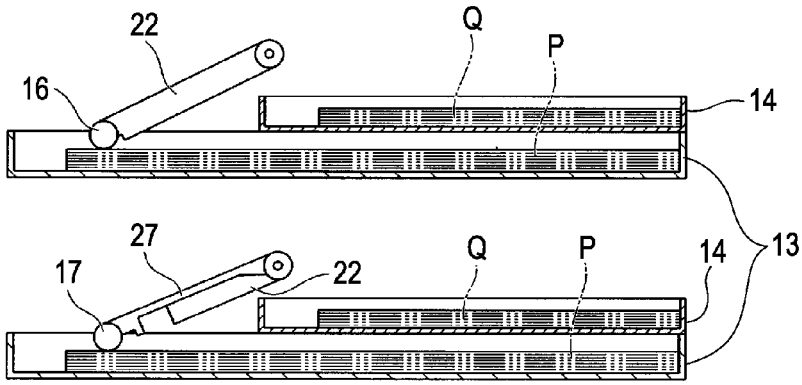
FIGS. 7A to 7C show the pick-up roller and the vicinity thereof during a sheet-feed operation from a first tray or the second tray.
Figure 7B:
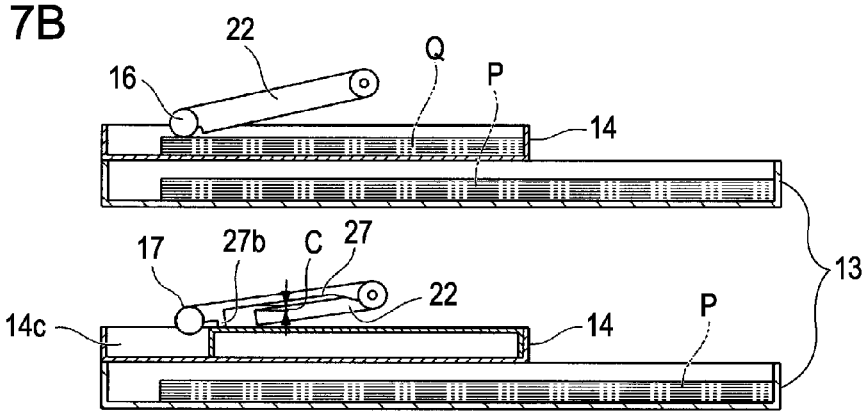
Figure 7C:
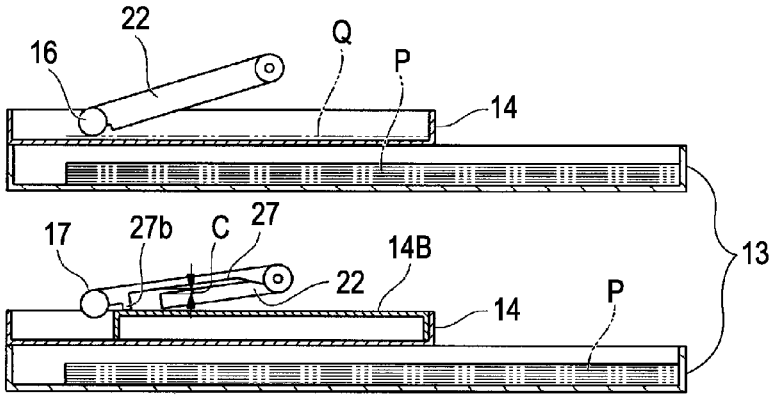

FIG. 1 is a perspective view showing the internal structure of an ink jet printer, which is an embodiment of the recording apparatus of the invention, FIG. 2 is a cross-sectional view showing the internal structure of the ink jet printer, FIGS. 3A and 3B are perspective views showing the structure of a sheet feeding cassette, FIG. 4 is a perspective view showing a state in which a second tray is located at a retracted position when the cassette is fitted, FIG. 5 is a perspective view showing a state in which the second tray is located at a feeding position when the cassette is fitted, FIG. 6 is a perspective view showing a state in which a lever is retracted, and FIGS. 7A to 7C show the pick-up roller and the vicinity thereof during a sheet-feed operation from a first tray or the second tray.

As shown in FIGS. 1 and 2, an ink jet printer 1 according to this embodiment is a serial printer that includes a carriage 40 capable of reciprocating in a width direction B intersecting a transportation direction A in a recording execution area 51, and a recording head 42 mounted on the bottom surface of the carriage 40. In the following description, the "downstream side" and "upstream side" in the transportation direction of a recording material P (Q) are defined based on the traveling direction of the recording material P (Q).

The ink jet printer 1 includes a printer body 2, a feed unit 3 that feeds the recording material P (Q), a recording execution unit 4 that performs recording on the recording material P (Q), a transportation unit 5 that transports the recording material P (Q) in the transportation direction, a discharge unit 6 that discharges the recording material P (Q), a control unit (not shown) that controls components of the printer, etc.

A sheet feeding cassette 11 that can accommodate a stack of different types and sizes of recording materials P and Q is removably fitted to the printer body 2, at the lower central portion of a front surface 2*a* thereof. As shown in FIG. 2, the sheet feeding cassette 11 includes a first tray 13 that can accommodate large (for example, A4-sized) recording materials P, such as plain paper, and a second tray 14 that can accommodate small (for example, L-sized, 2L-sized, and postcard-sized) recording materials Q, such as photographic paper. The sheet feeding cassette 11 has a two-tray structure in which the second tray 14 is disposed above (on the upper side in the sheet-stacking direction) the first tray 13 in a movable manner relative to the first tray 13 in the cassette inserting/removing direction.

The first tray 13 has an accommodating recess 13A inside thereof, which can accommodate A4-sized recording materials P. The accommodating recess 13A has a rectangular shape in plan view. The second tray 14 has substantially the same width (the width in the direction perpendicular to the cassette inserting/removing direction) as the first tray 13 and has a length in the cassette inserting/removing direction (the longitudinal direction) slightly larger than half of the overall length of the first tray 13 in the longitudinal direction. The second tray 14 has an accommodating recess 14A inside thereof, which can accommodate recording materials smaller in size in the width direction than the recording materials P, i.e., L-sized, 2L-sized, and postcard-sized recording materials Q. The accommodating recess 14A has a rectangular shape in plan view.

The second tray 14 can be moved relative to the first tray 13. More specifically, the second tray 14 is configured to be moved between a retracted position that is a relative position where a near end 13*a* of the first tray 13 and a near end 14*a* of the second tray 14 are aligned (see FIG. 3A) and a feeding position that is a relative position where a cassette inserting direction end 13*b* of the first tray 13 and a cassette inserting direction end 14*b* of the second tray 14 are aligned (see FIG. 3B). A switching mechanism (not shown) slides the second tray 14 in the cassette inserting/removing direction relative to the first tray 13.

The second tray 14 has the accommodating recess 14A that can accommodate the recording materials Q and a protruded portion 14B provided next to the accommodating recess 14A. The protruded portion 14B has a groove 14*c* extending toward the near end 14*a*. The groove 14*c* is provided at the cassette inserting direction end 14*b*, at a position corresponding to a driven roller 17, so that it can receive the driven roller 17 when the second tray 14 is disposed at the feeding position.

Furthermore, an edge guide 15*a* that can be moved in the sheet-width direction and an edge guide 15*b* that can be moved in the sheet-length direction (the feeding direction) are provided in each of the accommodating recess 13A in the tray 13 and the accommodating recess 14A in the tray 14, so that the edges of the recording materials P and Q can be guided at appropriate positions according to the sheet size. The edge guides 15*a* and 15*b* and the inner wall surfaces of the trays 13 and 14 guide the recording materials P and Q placed in the trays 13 and 14 from both sides.

The feed unit 3 includes a pick-up roller 16 that sequentially feeds the recording materials P (Q) accommodated in the first tray 13 (second tray 14) of the sheet feeding cassette 11 from the top, the driven roller 17 (FIG. 4: pressing portion) that adjusts the transportation orientation of the recording materials P (Q) fed by the pick-up roller 16 together with the pick-up roller 16, a separating slope 12 (18) that separates the top recording material P (Q) being fed and guides it to a U-shaped reversing path 50, a separating roller 21 that completely separates the top recording material P (Q) from the subsequent recording materials P (Q) that cannot be separated by the separating slope 12 (18), and intermediate transporting rollers 25 and 31 that transport the recording material P (Q) along the U-shaped reversing path 50.

As shown in FIGS. 1 and 2, the transportation unit 5 includes a unit frame 81 that constitutes the outer frame of the printer, a transporting roller 34 that sends the recording material P (Q) in the transportation direction, a tray 55 that holds an optical disc such as a CD-R, etc. The transporting roller 34 includes nip rollers, namely, a transportation driving roller 35 and transportation driven rollers 36, that are disposed on the downstream side of the intermediate transporting roller 31 in the transportation direction. The transportation driving roller 35 and the tray 55 are mounted on the unit frame 81. A platen 38 that supports the transportation orientation of the recording material P (Q) is provided on the unit frame 81.

The recording execution unit 4 includes the recording head 42 that performs recording on the recording material P (Q) and a carriage unit 101 that carries the recording head 42.

The recording head 42 is mounted to the bottom of the carriage 40 holding the ink cartridge and is disposed so as to face the platen 38 provided on the downstream side of the transporting roller 34 in the vertical direction. The recording head 42 performs predetermined recording on the recording material P (Q) fed on the platen 38 by the transporting roller 34.

As shown in FIGS. 1 and 2, the discharge unit 6 includes a discharging roller 43 and a discharging stacker 47. The discharging roller 43 includes nip rollers, namely, a discharging driving roller 44 and discharging driven rollers 45. The recording material P (Q) transported by the operation of the transporting roller 34 passes over the platen 38 and is fed to the nip point of the discharging roller 43. The discharging driving roller 44 and the transportation driving roller 35 are connected to the same driving motor, and thus, they are operated in conjunction with each other.

The discharging stacker 47, on which the recording material P (Q) after recording is stacked, is provided above the sheet feeding cassette 11. The discharging stacker 47 includes an extension stacker 48 that is accommodated in a nested manner in the discharging stacker 47 so as to be extendable and retractable.

When recording is performed on a recording material P with the ink jet printer 1, first, while the second tray 14 in the sheet feeding cassette 11 is disposed at the retracted position, the pick-up roller 16 pressed against the top recording material P of the recording materials P accommodated in the first tray 13 is rotated to feed the recording materials P one by one. The recording material P fed to the U-shaped reversing path 50 is guided and transported by the separating roller 21 and the intermediate transporting rollers 25 and 31. Then, the recording material P passes through the U-shaped reversing path 50 and is fed to the nip point of the transporting roller 34 on the downstream of side the U-shaped reversing path 50.

Because the platen 38 and the recording head 42, facing each other in the vertical direction, are disposed on the downstream side of the transporting roller 34, when the recording material P is fed on the platen 38 as the transportation driving roller 35 rotates and is transported to a position facing the recording head 42, the recording head 42 performs recording. The recording material P after recording is sent to the discharging stacker 47 by the discharging roller 43.

On the other hand, when recording is performed on a recording material Q, a switching mechanism (not shown) slides the second tray 14 in the sheet feeding cassette 11 to the feeding position. Because the second tray 14 is moved, the pick-up roller 16 and the driven roller 17 rest on the second tray 14. When the pick-up roller 16 pressed against the top recording material Q of the recording materials Q accommodated in the second tray 14 is rotated, the recording materials Q are fed one by one. Because the recording materials Q accommodated in the second tray 14 are smaller in width than the recording materials P, the driven roller 17 is in a retracted orientation when the second tray 14 is used. The subsequent transportation and recording are the same as those in the case of the recording materials P.

Next, the configurations of the pick-up roller 16, driven roller 17, and the vicinity thereof according to this embodiment will be described in detail.

As shown in FIG. 4, the pick-up roller 16 according to this embodiment is provided at the tip of a roller holder 22 that is supported at the base end by the unit frame 81 (FIGS. 1 and 2) so as to be rotatable (pivotable) about the axis O. The pick-up roller 16 is disposed above the insertion end of the sheet feeding cassette 11 that is inserted into the printer body 2. A first urging spring 23 fixed to a plate 81A mounted on the unit frame 81 is connected to the roller holder 22. The first urging spring 23 urges the roller holder 22 toward the sheet feeding cassette 11 so that the pick-up roller 16 is pressed against the surface of the recording material P.

When the pick-up roller 16 comes into contact with the top recording material of the recording materials P or Q accommodated in the first tray 13 or the second tray 14 and is rotated, the recording materials P or Q are picked up one by one from the first tray 13 or the second tray 14 and are fed to the transportation path.

The pick-up roller 16 is disposed at the reference position (one-digit side) located at one end of the roller holder 22 in the sheet-width direction of the recording materials P and Q. Thus, the pick-up roller 16 comes into contact with one end, in the width direction, of the top recording material of the recording materials P or Q accommodated in the sheet feeding cassette 11 to feed the recording material P or Q. Furthermore, the driven roller (pressing portion) 17 coaxial with the pick-up roller 16 is disposed at a predetermined position at the other end (80-digit side) in the sheet-width direction.

The driven roller 17 has the same diameter as the pick-up roller 16 and is provided at the tip of a lever 27 supported by the unit frame 81 and the roller holder 22 so as to be rotatable about the axis O. The lever 27 is placed on the roller holder 22 such that it is disposed in a recess 22A provided in the roller holder 22, and the base end of the lever 27 is supported coaxially with the roller holder 22.

Furthermore, as shown in FIGS. 4 and 5, a second urging spring 24 fixed to the plate 81A is connected to the lever 27. The second urging spring 24 urges the lever 27 toward the sheet feeding cassette 11 so that the driven roller 17 is pressed against the surface of the recording material P. When the recording material P is fed from the first tray 13, the driven roller 17 and the pick-up roller 16 make the transportation orientation of the recording material P, fed as the pick-up roller 16 rotates, uniform in the sheet-width direction.

Furthermore, when the second tray 14 is disposed at the feeding position, the driven roller 17 is in the groove 14*c* provided in the protruded portion 14B, and a protruding portion 27*b* provided on the bottom surface of the lever 27 comes into contact with a top surface 14*d* of the protruded portion 14B. Thus, the driven roller 17 is retracted. Herein, a state in which "the driven roller 17 is retracted" refers to a state in which the driven roller 17 does not affect the sheet-feed operation of the pick-up roller 16, and, hereinafter, this state will be referred to as a "retracted orientation".

As shown in FIG. 6, the lever 27 supporting the driven roller 17 has the protruding portion 27*b* having a predetermined height on the bottom surface facing the second tray 14. The height of the protruding portion 27*b* is such that a clearance C is provided between an inner surface 27*a* of the lever 27 and a top surface 22*a* of the roller holder 22 when the protruding portion 27*b* is in contact with the top surface 14*d* of the protruded portion 14B of the second tray 14. More specifically, the protruding portion 27*b* projects toward the second tray 14 from the inner surface 27*a* of the lever 27 facing the top surface 22*a* of the roller holder 22.

The lever 27 and the roller holder 22 are pushed up by the second tray 14 that is moved by a force resisting the urging force exerted by the first urging spring 23 and the second urging spring 24. When the second tray 14 is disposed at the feeding position, the protruding portion 27*b* of the lever 27 is in contact with the top surface 14*d* of the protruded portion 14B of the second tray 14, preventing the lever 27 from being lowered any further. At this time, only the roller holder 22 is lowered, and the pick-up roller 16 is pressed against the surface of the recording materials Q accommodated in the second tray 14.

When the protruding portion 27*b* of the lever 27 is in contact with the top surface 14*d* of the protruded portion 14B of the second tray 14, and the driven roller 17 is in a retracted orientation, the driven roller 17 in the groove 14*c* in the second tray 14 is floating in the air. Thus, the lever 27 is located at a distance from the top surface 22*a* of the roller holder 22 because of the protruding portion 27*b* having a predetermined height.

As has been described above, the pick-up roller 16 is disposed on the one-digit side in the sheet-width direction (on the upper right side in FIG. 4). Thus, depending on the sheet size, the pick-up roller 16 is shifted to the one-digit side of the sheet.

In this case, when the recording material P is curved and reversed by the separating slope 12 and the separating roller 21 on the downstream side so as to form a substantially U shape, the orientation of the recording material P, in a curved shape, is nonuniform in the sheet-width direction, that is, the driven roller 17 (80 digit) side is fed first, which may cause skew. In particular, because this embodiment employs a two-tray cassette structure, if the pick-up roller 16 and the driven roller 17 are supported by the same member, the pick-up roller 16 is subjected to the load due to strain when the second tray 14 is used. Thus, skew is more likely to occur. That is, when the sheet size is small, the driven roller 17 is not used and is accommodated in the second tray 14. At this time, because the driven roller 17 is in contact with the top surface 14*d* of the second tray 14, the pick-up roller 16 is more likely to be subjected to the load.

To counter this, in this embodiment, the pick-up roller 16 (on the one-digit side) and the driven roller 17 (on the 80-digit side), which are disposed coaxially with each other, are respectively supported by the roller holder 22 and the lever 27 that are independent of each other, so that loads on the rollers can be independently controlled. That is, because the lever 27 is not resting on the roller holder 22 but is floating in the air when the driven roller 17 is accommodated in the second tray 14, the load on the lever 27 is not transmitted to the pick-up roller 16 through the roller holder 22. Thus, the orientation of the recording material Q, in a curved shape, is uniform in the sheet-width direction even when the second tray 14 is used.

That is, in this embodiment, because the load on the pick-up roller 16 and the load on the driven roller 17 can be independently controlled, the pick-up roller 16 is not subjected to the load even when the second tray 14 is used. Thus, the occurrence of sheet skew can be reduced.

Next, the pick-up roller 16 and the vicinity thereof during a sheet-feed operation from the first tray 13 or the second tray 14 will be described. FIGS. 7A to 7C show the pick-up roller 16 and the vicinity thereof during a sheet-feed operation from the first tray 13 or the second tray 14.

As shown in FIG. 7A, when the first tray 13 is used (in a sheet-Max state), both the pick-up roller 16 and the driven roller 17, disposed coaxially with each other, are in contact with the top recording material P of the recording materials P accommodated in the first tray 13. The pick-up roller 16 and the driven roller 17 are always pressed against the top recording material P and are lowered as the number of the recording materials P in the first tray 13 decreases.

As shown in FIG. 7B, when the second tray 14 is used (in a sheet-Max state), the pick-up roller 16 is in contact with the top recording material Q, and the driven roller 17 is in the groove 27*c* in the second tray 14. At this time, the lever 27 is resting on the protruded portion 14B, such that the protruding portion 27*b* is in contact with the protruded portion 14B.

Thus, as shown in FIG. 7C, only the pick-up roller 16 is always pressed against the top recording material Q, and the pick-up roller 16 is lowered as the number of the recording materials Q in the second tray 14 decreases. When the second tray 14 is used, because the lever 27 is located at a distance from the roller holder 22 because of the protruding portion 27*b*, a clearance is provided between the lever 27 and the roller holder 22. Thus, the load on the driven roller 17 is not transmitted to the pick-up roller 16.

According to this embodiment, in the sheet feeding cassette 11 having the trays 13 and 14, it is possible to provide the ink jet printer 1 that can prevent skew and effectively reduce feeding failure regardless of the tray from which the recording materials P and Q are fed.

Although the preferred embodiment of the invention has been described with reference to the attached drawings, the invention is of course not limited to such an example. As will be evident to those skilled in the art, various modifications can be made within the scope of the claims, and they are of course within the scope of the invention.

What is claimed is:

1. A recording apparatus comprising:

a sheet feeding cassette that can accommodate a stack of recording materials;

a pick-up roller that comes into contact with the top recording material of the recording materials accommodated in the sheet feeding cassette to feed the recording material;

a roller holder that is supported at a base end so as to be rotatable and has the pick-up roller at a tip, the pick-up roller being pressed against the recording material; and a lever that is supported at a base end so as to be rotatable and has a pressing portion at a tip, the pressing portion being pressed against the recording material, wherein the lever is disposed in a recess of the roller holder and is supported coaxially with the roller holder, wherein the pressing portion is a driven roller having the same diameter as and coaxial with the pick-up roller.

2. The recording apparatus according to claim 1, wherein the sheet feeding cassette accommodating the recording materials includes a first tray that accommodates a first recording material and a second tray that is disposed above the first tray and accommodates a second recording material smaller in width than the first recording material, and wherein the lever includes a position-regulating portion such that the lever is located at a distance from the top surface of the roller holder when the second recording material is fed.

3. The recording apparatus according to claim 2, wherein the second tray has, in the top surface, a groove that receives the pressing portion of the lever when the second tray is used, and wherein the position-regulating portion comes into contact with the top surface of the second tray and has a height such that it projects toward the second tray from the bottom surface of the lever facing the top surface of the roller holder.

4. The recording apparatus according to claim 1, wherein an urging member is connected to each of the roller holder and the lever.

5. A recording apparatus comprising:

a sheet feeding cassette that can accommodate a stack of recording materials;

a pick-up roller that comes into contact with the top recording material of the recording materials accommodated in the sheet feeding cassette to feed the recording material;

a roller holder that is supported at a base end so as to be rotatable and has the pick-up roller at a tip, the pick-up roller being pressed against the recording material; and a lever that is supported at a base end so as to be rotatable and has a pressing portion at a tip, the pressing portion being pressed against the recording material, wherein the pressing portion is a driven roller having the same diameter as and coaxial with the pick-up roller, wherein the lever is disposed in a recess of the roller holder and is supported coaxially with the roller holder.

6. A recording apparatus comprising:

a first tray that accommodates a first recording material;

a second tray that is disposed above the first tray and accommodates a second recording material smaller in width than the first recording material;

a pick-up roller that comes into contact with the top recording material of the recording materials accommodated in the sheet feeding cassette to feed the recording material;

a roller holder that is supported at a base end so as to be rotatable and has the pick-up roller at a tip, the pick-up roller being pressed against the recording material; and a lever that is supported at a base end so as to be rotatable and has a pressing portion at a tip, the pressing portion being pressed against the recording material, wherein the lever is disposed in a recess of the roller holder and is supported coaxially with the roller holder and wherein the pressing portion is a driven roller having the same diameter as and coaxial with the pick-up roller;

wherein the pick-up roller and the pressing portion of the lever are located at the top surface of first recording material when the first tray is disposed at the feeding position, wherein the pressing portion of the lever is located at a distance from the top surface of second recording material when the second tray is disposed at the feeding position.

7. A recording apparatus comprising:

a first tray that accommodates a first recording material;

a second tray that is disposed above the first tray and accommodates a second recording material smaller in width than the first recording material;

a pick-up roller that comes into contact with the top recording material of the recording materials accommodated in the sheet feeding cassette to feed the recording material;

a roller holder that is supported at a base end so as to be rotatable and has the pick-up roller at a tip, the pick-up roller being pressed against the recording material; and a lever that is supported at a base end so as to be rotatable and has a pressing portion at a tip, the pressing portion being pressed against the recording material, wherein the lever is disposed in a recess of the roller holder and is supported coaxially with the roller holder and wherein the pressing portion is a driven roller having the same diameter as and coaxial with the pick-up roller;

wherein the pick-up roller and the pressing portion of the lever are located at the top surface of first recording material when the first tray is disposed at the feeding position, wherein the pressing portion of the lever is located at a distance from the top surface of second recording material when the second tray is disposed at the feeding position.

* * * * *